United States Patent [19]

Manner

[11] Patent Number: 4,877,145

[45] Date of Patent: Oct. 31, 1989

[54] RIBBON WRAPPED INTRINSIC OPENING PLASTIC PACKAGE

[75] Inventor: Warren R. Manner, 11652 Camden St., Omaha, Nebr. 68164

[73] Assignee: Warren R. Manner, Omaha, Nebr.

[21] Appl. No.: 161,479

[22] Filed: Feb. 29, 1988

[51] Int. Cl.[4] ..... B65D 6/10

[52] U.S. Cl. ..... 220/83; 229/125.15; 206/621.3

[58] Field of Search ..... 220/83, 85 SP; 229/125.15, 125.22, 125.19, 125.26, 125.38, 125.42, 160.2; 206/621.1, 621.3, 621.5, 621.6

[56] References Cited

U.S. PATENT DOCUMENTS

| | | | |
|---|---|---|---|
| 2,064,029 | 12/1936 | Murray | 206/621.3 |
| 2,593,778 | 4/1952 | McGinnis | 206/621.3 |
| 2,772,823 | 12/1956 | Plamann | 383/906 |
| 3,185,374 | 5/1965 | Feeney | 206/621.3 |
| 3,982,683 | 9/1976 | Forteau | 206/621.3 |

FOREIGN PATENT DOCUMENTS

| | | | |
|---|---|---|---|
| 1454695 | 11/1976 | United Kingdom | 206/621.3 |

*Primary Examiner*—Willis Little

[57] ABSTRACT

A clear or near-clear plastic package to aid in the display and inspection of contents with an intrinsic molded easy opening and closing spout which can be held closed with physical locks and a ribbon like wrapping seal and double sided information posters affixed thereon.

19 Claims, 7 Drawing Sheets

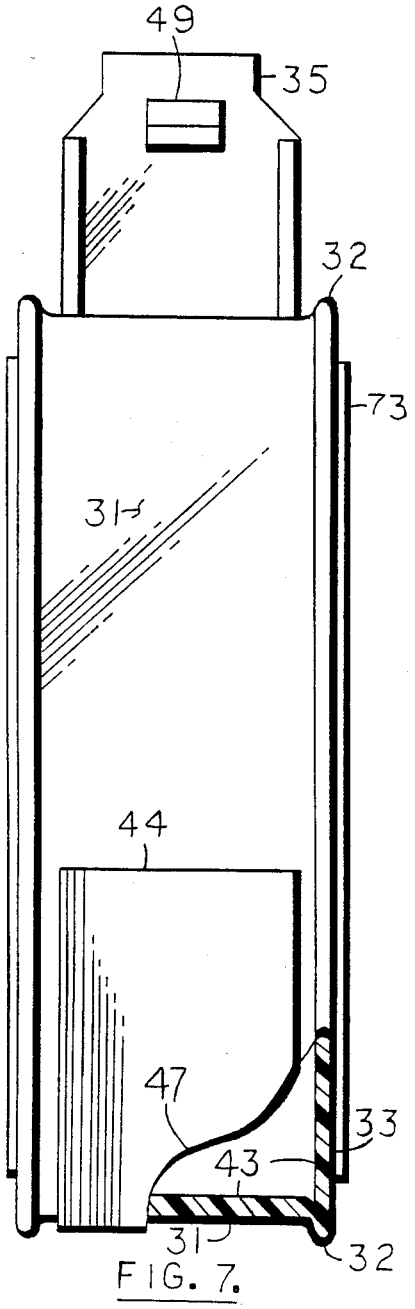
FIG. 7.
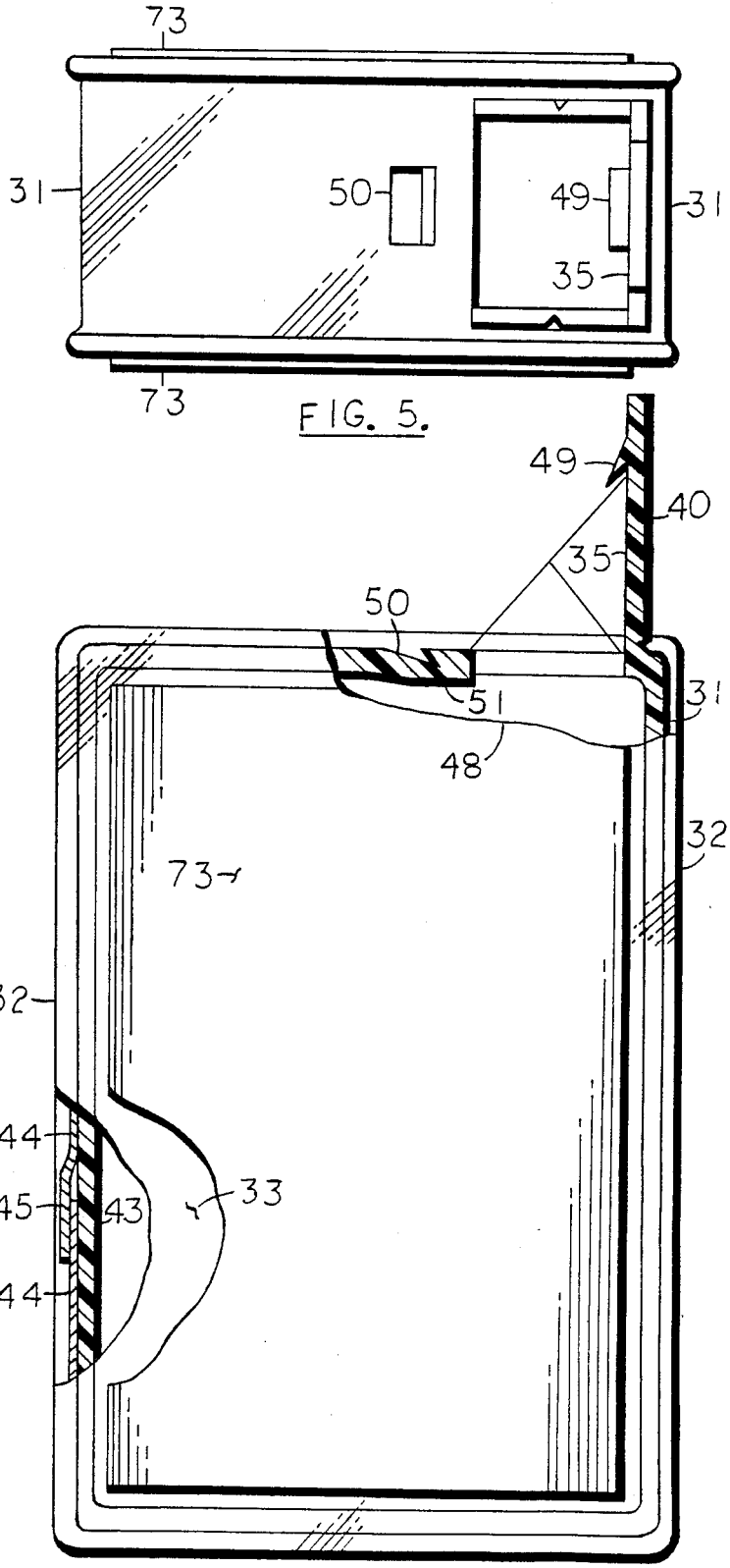
FIG. 5.
FIG. 6.

RIBBON WRAPPED INTRINSIC OPENING PLASTIC PACKAGE

CROSS REFERENCE TO RELATED APPLICATIONS

Patent Disclosure #164897,'Ribbon Wrap Packaging System' submitted to the Commissioner of Patents and Trademarks on February 25, 1987.

Rights to invention made under Federally-Sponsored Research and Development: None.

BACKGROUND FIELD OF INVENTION

This invention relates to dry-goods packaging, specifically the display or inspection of the contents therein, easily opened and closed and providing a protective seal thereof for a wide variety of products.

BACKGROUND DESCRIPTION OF PRIOR ART

Many if not all consumers like to see what they are purchasing before they buy it. Conversely manufacturers would like to display their products, which they go through great efforts to make attractive or palatable, prior to retailing. Additionally, manufacturers expend great amounts of time and money to describe or advertise what they have put into the package.

Heretofore paper or cardboard packages, that you can not see through, are all that has been available for retailing of products.

These cardboard packages are of various sizes and shapes and to date rely on pictures and narrative written descriptions to explain what is on the inside. The pictures and narratives at times do not accurately or adequately portray the image the manufacturer wants to create. Also customers may misunderstand the product description becoming distraught with the manufacturers and wanting to return the goods. Unfortunately lawsuits may result over this misunderstanding.

Cardboard packages do have a degree of tamper-proof sealing with glued edges and ends. Cardboard packages that are glued can be mishandled and break open, accidently losing the contents.

Cardboard packages requiring a vapor barrier either have a waxed paper or more recently a thin plastic liner bag therein that is sealed, inserted, filled and sealed again during a secondary manufacturing process.

A common occurance among customers is first they have to unglue the package opening and then cut or tear the inner-liner bag. Inadvertently the liner tears or cuts with an irregular opening. When the contents is then poured or removed from the irregularly opened package, it pours in a messy inconsistent pattern or the volume expelled can be too great or too little. Additionally, the incorrectly opened package and liner can not be resealed for storage and retained freshness.

Most customers and manufacturers, therefor, would find it desirable to have a package which would allow visual display and inspection of the contents, with a protective seal during shipping and storage prior to purchasing, along with easy opening, removal of contents and closing of said package.

SUMMARY OF THE INVENTION

Accordingly I claim the following as my objects and advantages of the invention: to provide a package molded of clear or near-clear plastic for visible display and inspection of its contents, to provide a tamper-proof and impermeable ribbon wrap seal at point of manufacturing for customer protection, and to provide a intrinsic molded spout or opening of an design practical for the manufacturer to fill through and for the customer to be able to open and close.

The clear or near-clear molded plastic package will allow the manufacturer to display their product without the package being opened or expensive pictures and narrative, descriptive advertising. The manufacturer can reveal to the customer the product therein by exposing a portion of the package's surface, for example the edges being unobstructed with plaques or posters. The package face, back, top, bottom and sides can still have advertisement, product information and corporate identification applied to these surfaces with posters or film printed materials. The customer being able to see into the package's unobstructed edges, as to what they are purchasing, will not misunderstand what they are buying and can make an 'on the spot' buying decision with no resentment. Cardboard packages have an inherent disadvantage being manufactures of an opaque material. The advantage to my invention claimed herein, of a clear or near-clear molded plastic package is the ability to see the contents.

Additionally the plaques or posters fixed to the surfaces of the plastic packages can have additional printed material on the back or inside of said plaque or poster. The customer being able to see through the package will realize, as the package empties, there is additional information of the backs of the posters. The customer can remove, of removable, the posters and use said information printed on the reverse side of the posters. In effect this double printing of both sides of affixed posters greatly increases the advertising space available to the manufacturer, heretofore not practical with cardboard packages.

The molded clear or near-clear plastic package will not have glued seams, unlike cardboard glued seams, which through neglect or mishandling can accidently open thus losing its contents. The preferred embodiment of this package design and construction is a package molded out of one piece of blow molded plastic material with no seams or joints other than the industry accepted mating joint, such as that found on a molded bottle.

To seal the package and keep the opening closed, a ribbon wrap is provided to circumvent the package, covering the opening. The ribbon wrap could be a paper material but preferably a plastic film that is bound to the package surface, heat shrunk on, or stretched over the package opening. The ribbon wrap additionally provides a vapor barrier function if the goods package therein require such a degree of protection for retaining freshness as would be the case of dried food goods. The ribbon wrap can be printed with pertinent information about the product in the package and also the pricing bar codes desired or mandated by retailers. The printing of the pricing bar codes on this ribbon wrap surface would reduce the package printing cost incurred by the manufacturer when the prices are changed. The consumer is protected by use of this ribbon wrap seal and is assured of a fresh, unused product because the ultimate user will have to peel or pull off the ribbon wrap when they want to open the package. The flexibility of reprinting only a small portion, the ribbon wrap, of the package and the tamper evident feature of the ribbon wrap is not practical on cardboard packages.

Additionally the ribbon wrap, when functioning as a vapor barrier seal, also eliminates the need for the waxed paper or plastic liner used in cardboard packages. Thus, a cost reduction, by eliminating the liner, and a manufacturing process is eliminated because the plastic molded package and ribbon wrap replace the cardboard package liner.

A major feature of this invention is the intrinsic molded spout or opening and the ability to re-close the closure for storage. With this plastic molded closure device, various styles of spout can be designed into the package to provide for a uniform, consistant, pouring mechanism. The spout will not tear or open irregularly like a cardboard package opening. Therefore the clear or near-clear plastic package and intrinsic spout will provide for neat, consistent, predictable dispensing of the contents therein.

Readers will find further objects and advantages of the invention from a consideration of the ensuing description and the accompanying drawings.

DRAWING FIGURES

FIG. 5 is a top view of invention with tab and groove closure.

FIG. 6 is a cross section side view of FIG. 5.

FIG. 7 is a cross sectional end view of FIG. 5.

DRAWING REFERENCE NUMBERS

Figure 4:
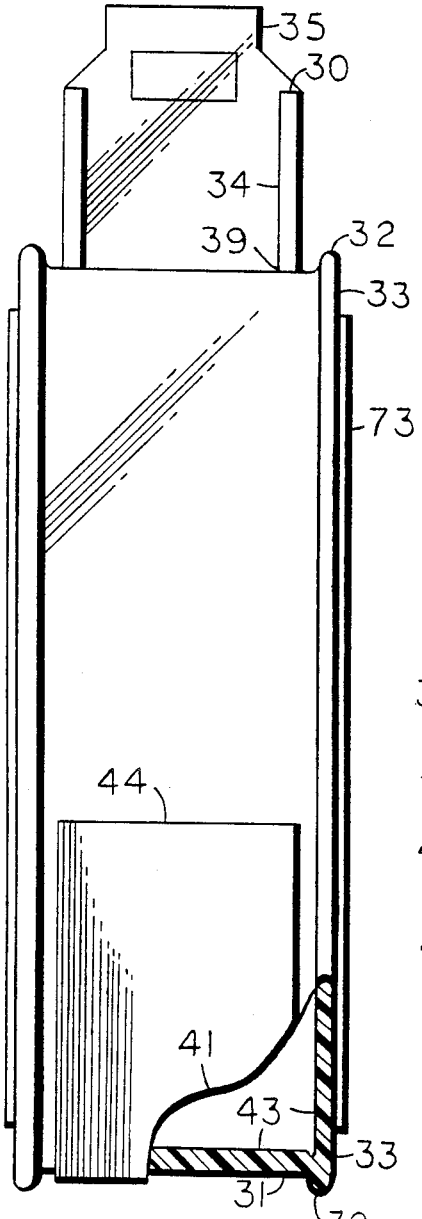
FIG. 4 is a cross sectional end view of FIG. 2.
Figure 3:
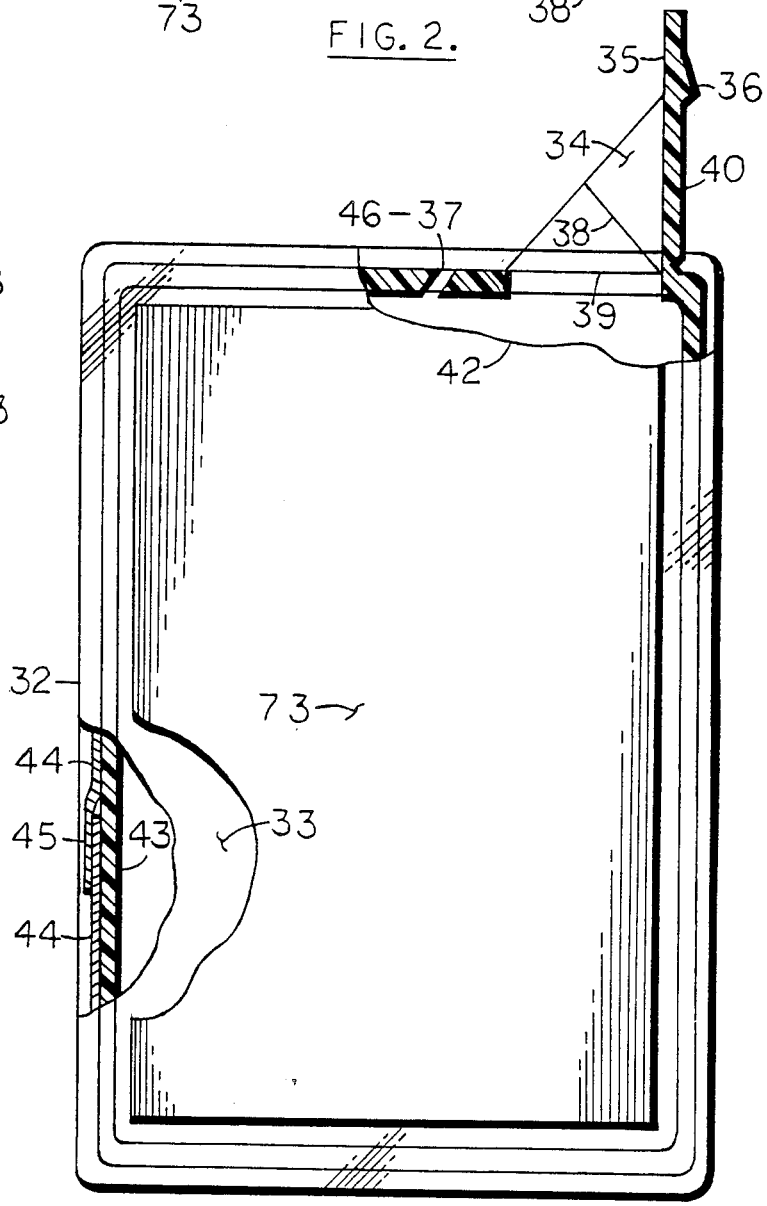
FIG. 3 is a cross sectional view of FIG. 2.
Figure 10:
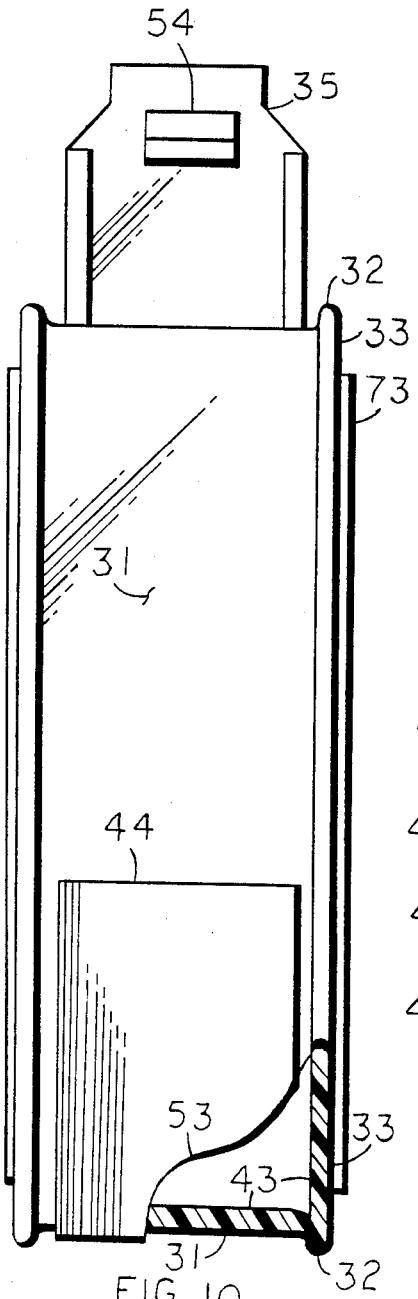
FIG. 10 is a cross sectional end view of FIG. 8.
Figure 9:
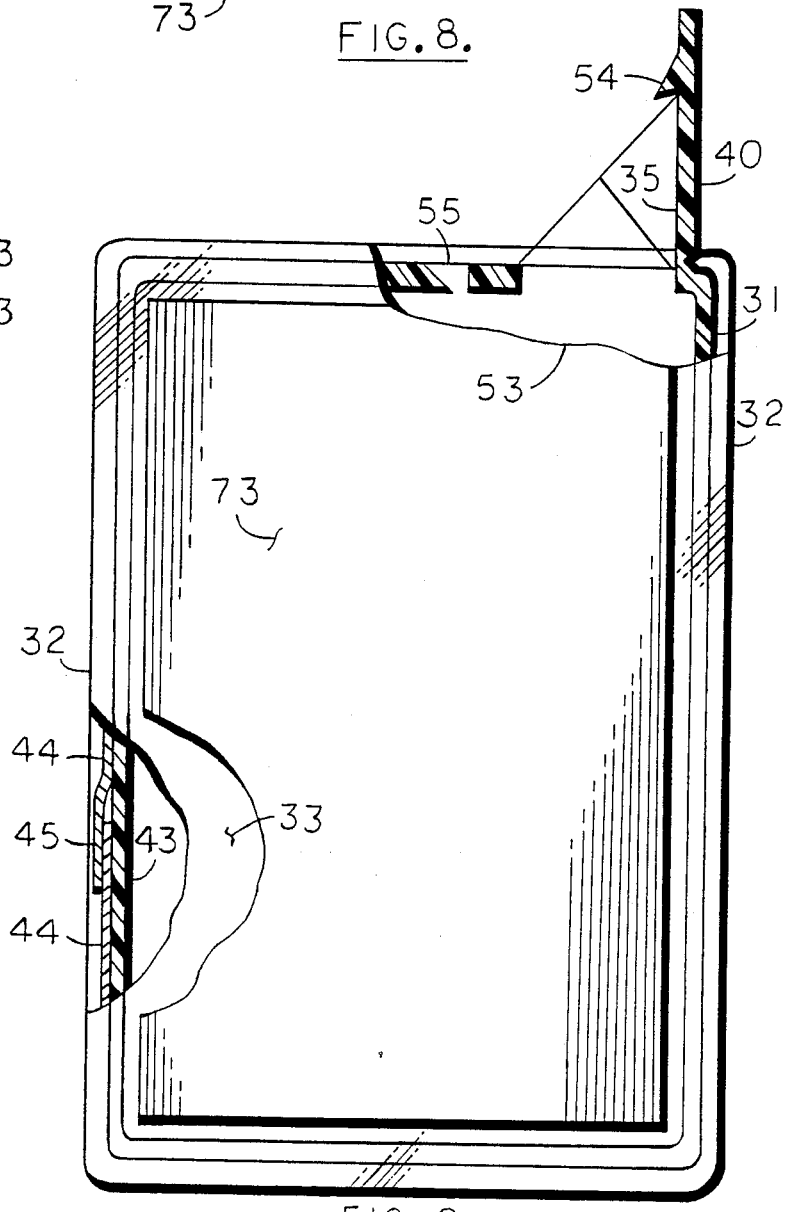
FIG. 9 is a cross sectional side view of FIG. 8.
Figure 13:
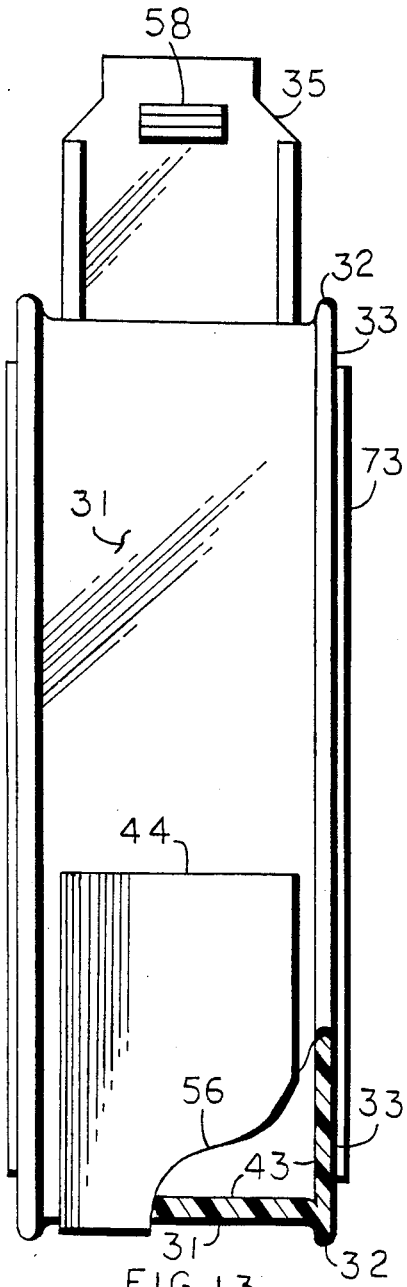
FIG. 13 is a cross sectional end view of FIG. 11.
Figure 12:
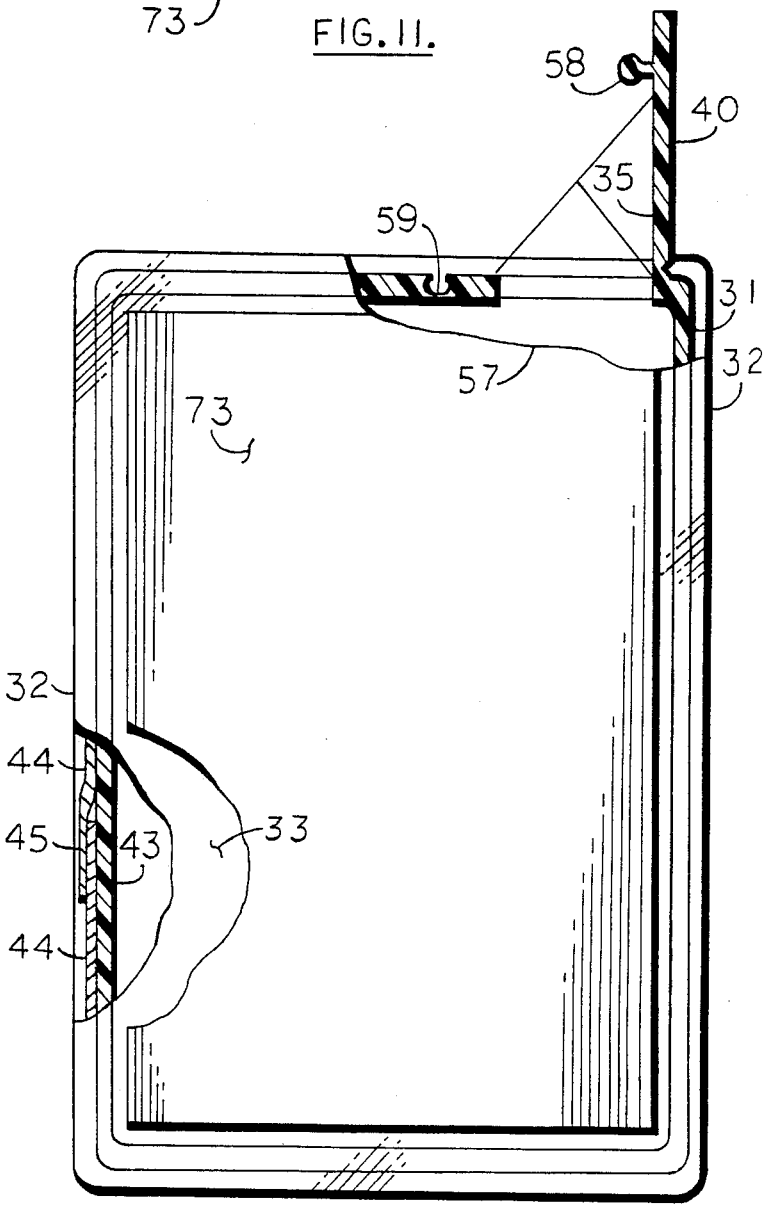
FIG. 12 is a cross section side view of FIG. 11.
Figure 16:
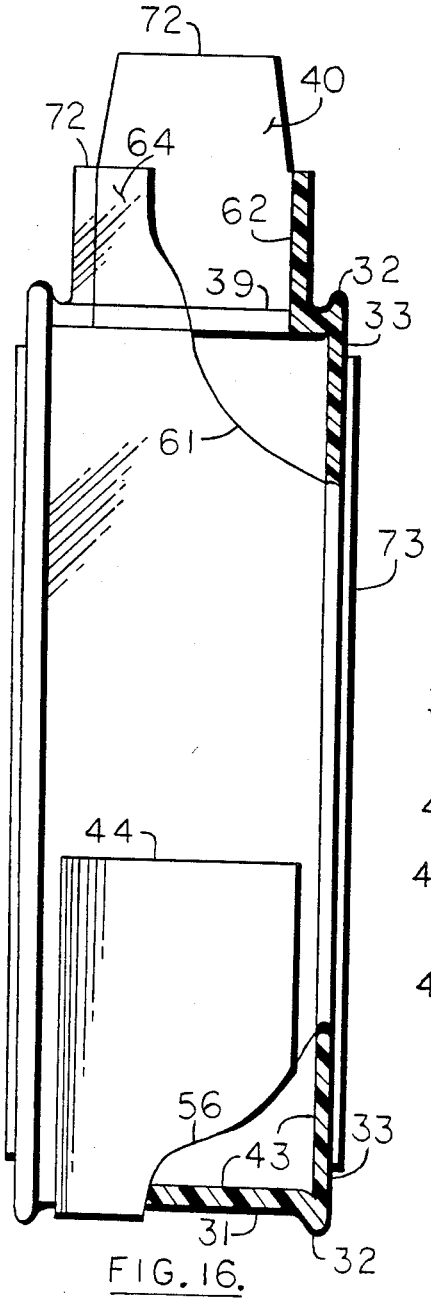
FIG. 16 is a cross sectional end view of FIG. 14, tab open.
Figure 15:
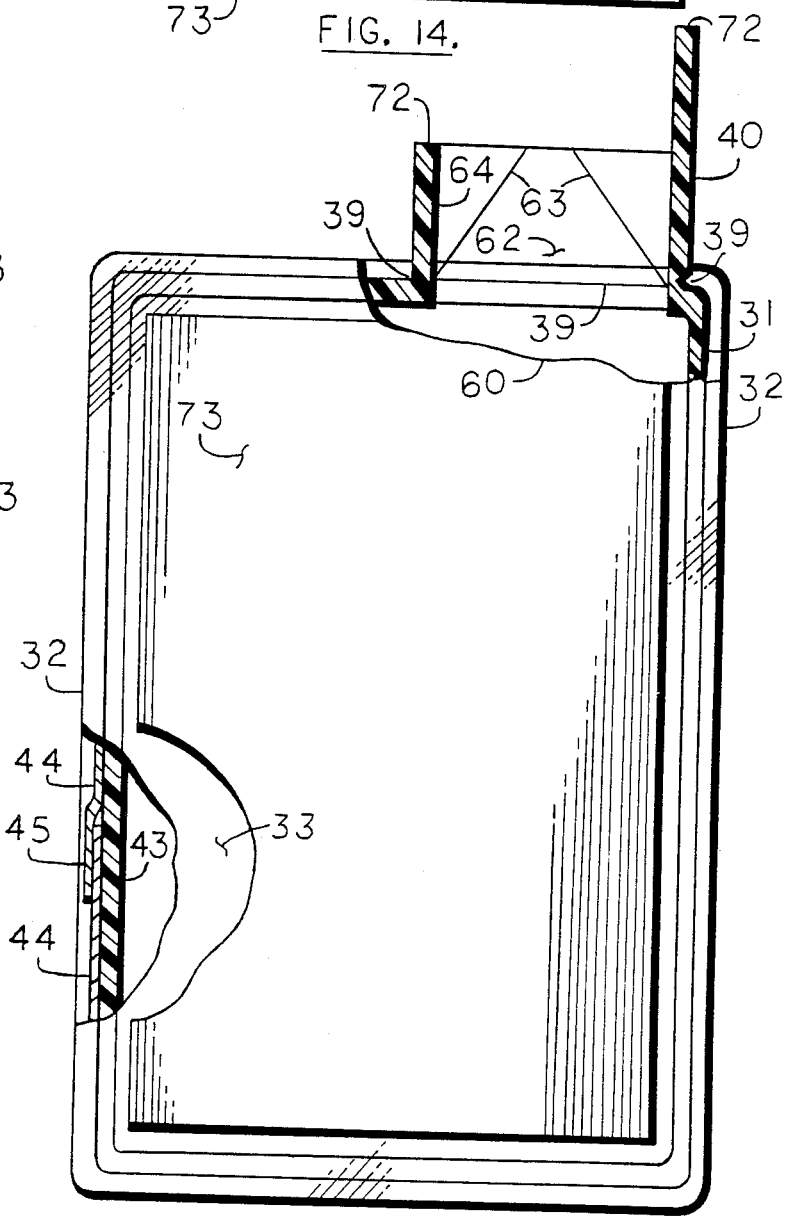
FIG. 15 is cross sectional side view of FIG. 14, tab open.
Figure 18:
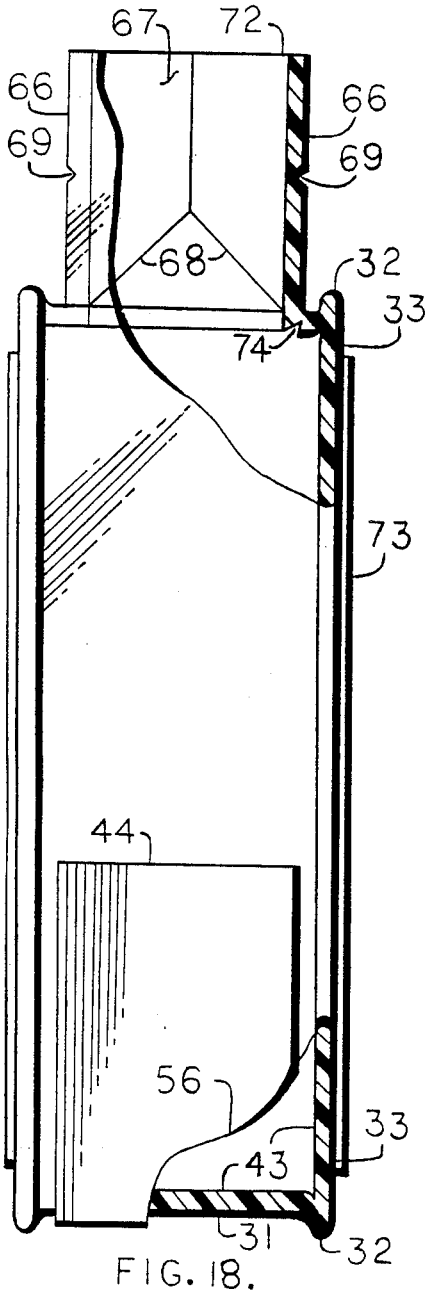
FIG. 18 is a cross sectional end view of FIG. 17, top open.
Figure 19:
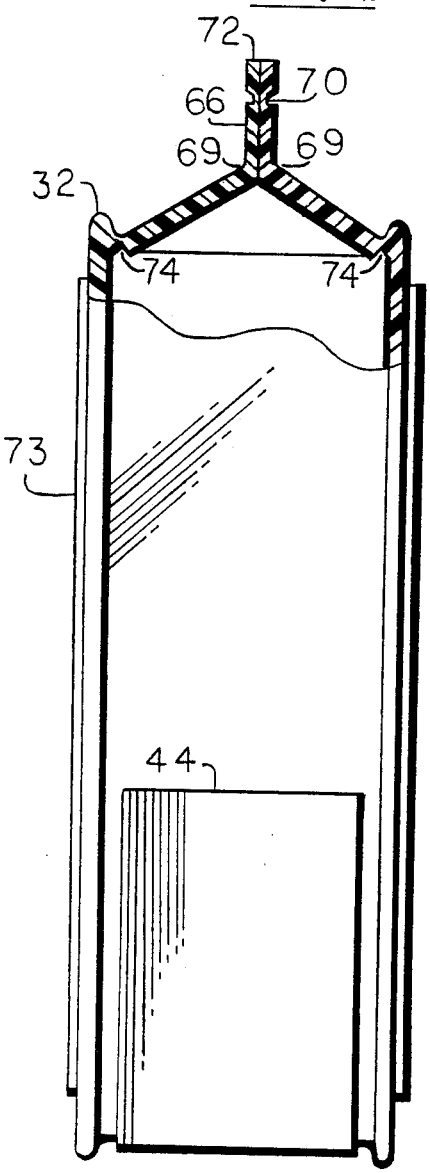
FIG. 19 is a cross section end view of FIG. 17, top heat sealed and not folded flat.

30 live hinge relied, flap 40 to spout support 34.
31 recessed ends, top and bottom surfaces.
32 raised protective ridge edge.
33 front and back surface.
34 spout, support sides.
35 closure tab part of flap 40.
36 thumb grip tab on flap 40.
37 slot for closure tab 35.
38 live hinge relief, spout support 34.
39 live hinge relief for flap 40 at surface 31.
40 intrinsic spout flap.
41 cross section line for FIG. 4.
42 cross section line for FIG. 3
43 cross section thickness of plastic package
44 ribbon wrap seal
45 overlap bond point for ribbon wrap seal 44
46 location of adhesive material for closure tab 35
47 cross section line for FIG. 7
48 cross section line for FIG. 6
49 closure interlock tab grip on tab 35 and flap 40
50 closure interlock groove for tab grip 49
51 thicker material section for groove 50
52 cross section line for FIG. 10
53 cross section line for FIG. 9
54 closure tension tab grip on tab 35 and flap 40
55 closure tension slot for tab grip 54
56 cross section line for FIG. 13
57 cross section line for FIG. 12
58 closure snap lock bar on tab 35 and flap 40
59 closure snap lock groove for bar 58
60 cross section line for FIG. 15
61 cross section line for FIG. 16
62 spout support sides, full length, connected to flap 40 and spout end flap 64
63 live hinge relief lines, spout support 62
64 spout end flap
65 cross section line for FIG. 18 and FIG. 19
66 full length side flaps
67 ends flaps connecting side flaps 66
68 live hinge relief line on end flaps 67
69 live hinge relief lines on side flaps 66
70 heat seal line on side flaps 66
71 directional line of side flaps 66 folded flat
72 edge of opening
73 poster or plaque
74 live hinge relief line for spouts ar surface 31

DESCRIPTION

Figure 1:
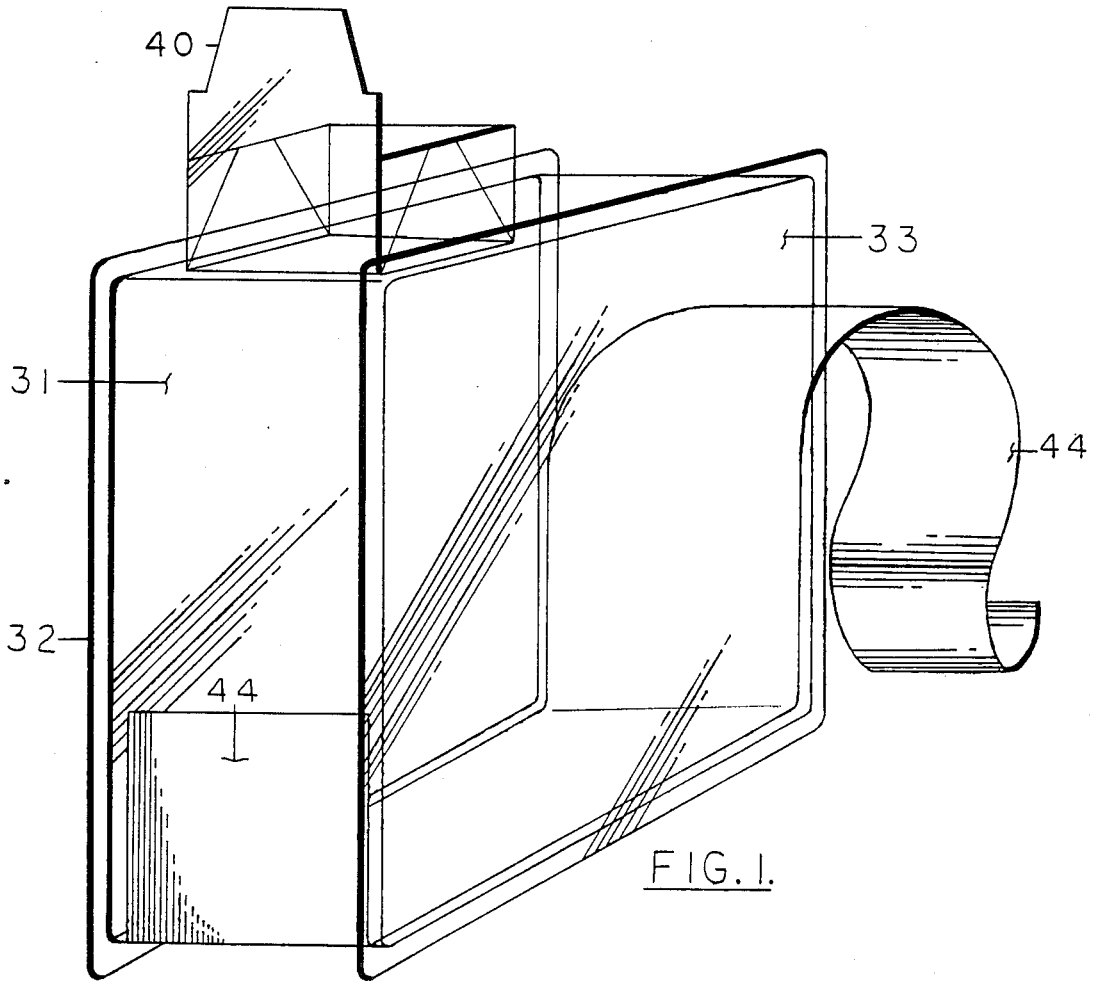
FIG. 1 is a perspective view, 3 dimensional, of a one piece clear plastic package with spout open and ribbon wrap partially attached and unattached.

FIG. 1 shows a molded clear or near clear plastic package with an internally molded spout according to the preferred embodiment of the invention. The package, in FIG. 1, shows a spout detailed in FIG. 14, 15, and 16 utilizing a tuck tab flap 40. The package preferably being blow molded clear thermoplastic of one piece construction having ends, top, and bottom surfaces 31 recessed below the raised protective edge 32. Front and back surfaces 33 are flat to accomodate posters 73 identifying the product therein. Ribbon wrap 44 is partialy removed from the circumference of recessed surface 31.

Figure 2:
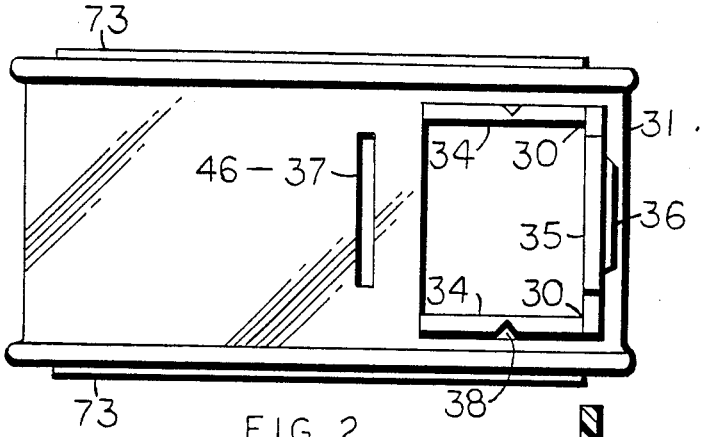
FIG. 2 is a top view, ribbon wrap intrinsic opening plastic package with tab and slot or adhesive closure.

FIG. 2, 3, and 4 detail the recessed surface 31 on the top, bottom and ends of the package molded contiguously up and over the raised edge 32 connecting to the front and back surface 33. The raised protective edge 32 completely circumvallates both edges of the package and develops an uninterrupted connected surface with no seams. The clear plastic package preferably blow molded from a one piece parison with a uniform wall thickness 43 through all cross sections, and of a thickness to be self supporting yet as thin as practical without affecting dimensional stability. The continuous raised protective ridge 32 will aid in package strength by being double the wall thickness 43 where it is molded back on itself. Molded spout sides 34 and flap 40 are intrinsically connected to top surface 31 at live hinge relief line 39. Two molded spout support sides 34 are intrinsically connected to flap 40 at live hinge relief line 30. Spout support sides 34 having line hinge relief lines 38 to allow the sides to collapse into and over the spout package opening. Flap 40 also folds over the spout opening and spout sides 34 where tab 35 is inserted into slot 37, an elongated hole through surface 31, FIG. 2 and 3, to secure spout flap 40 in a closed position. Tab 35 could incorporate a thumb grip raised surface 36 to accommodate easier allignment and insertion, or retraction, of tab 35 into, or out of, slot 37. Tab 35 may also be retained in a closed position by placing an adhesive, such as a contact cement or tape, at point 46 on top surface 31, eliminating slot 37 in surface 31. By folding spout sides 34 and flap 40 over the package opening, the product contained therein remains in the package reducing accidental spillage and retaining freshness of the contents. Ribbon wrap protective seal 44, FIG. 1, 3 and subsequent figures, circumvents the recessed ends, top, and bottom surface 31. The ribbon wrap seal 44 spans nearly the full width of the recessed surface 31, FIG. 1, and is protected from damage by raised edge 32. The ribbon wrap seal 44 length is determined by the size of the package and is intended to overlap itself at point 45, where ever point 45 is deemed practical and bonded, fused or adhered to itself at point 45. The preferred embodiment of this invention is to have the ribbon wrap 44 manufactured from a elastomeric clear or near clear, printable, plastic film cut to a suitable ribbon width comparable to the package width. The ribbon wrap seal 44 may extend beyond the package width and overlap the protective raised edge 32. Thus the oversized ribbon wrap 44 configuration would increase the surface area of the ribbon wrap protective seal 44 and reduce the permiability of atmospheric environment into said package. The ribbon wrap seal 44 is to cover and seal the intrinsic spout when spout sides 34 and flap 40 are folded flat or closed. The ribbon wrap seal 44 can be a clear or opaque, printed or non-printed plastic film or other material such as paper or cardboard with the main function being to keep the package opening closed and sealed.

Subsequent figures 4 to 19 utilize the same package design and ribbon wrap seal 44 as described in FIG. 1,2,3 and 4 and intended by this invention with the exceptions being the intrinsic spout design described in the following figures.

FIG. 5, 6 and 7 utilize the ribbon wrap seal 44 and the clear or near clear plastic package having surfaces 33, surface ends, top and bottom 31 and protective raised edge 32. Flap 40 of intrinsic spout has molded on the tab 35 an elongated, cantilevered interlocking gripper 49. When flap 40 is folded closed interlocking gripper 49 engages the elongated cantilevered groove 50 in the enlarged thickness 51 of surface 31 this closing the opening of said package.

Figure 8:
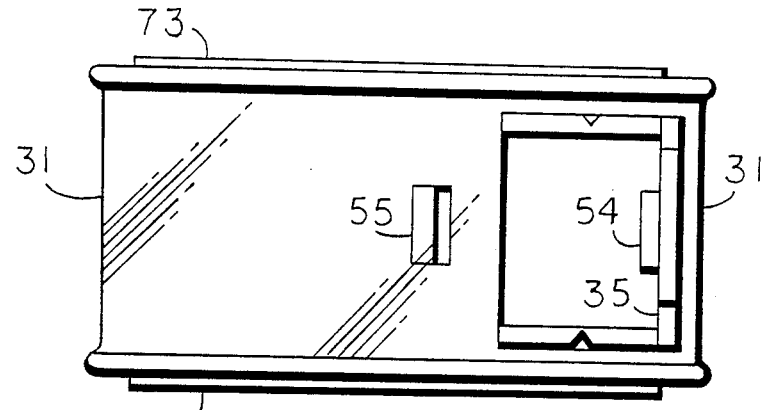
FIG. 8 is a top view of invention with tension lock closure.

FIG. 8, 9 and 10 utilize the ribbon wrap seal 44 and the clear or near clear plastic package design having surfaces 33, recessed top, bottom and end surfaces 31 and raised protective edge 32. Flap 40 of intrinsic spout has molded on tab 35 an elongated, cantilevered tension gripper 54. When flap 40 is folded closed the tension gripper 54 engages the elongated slot 55 through surface 31, thus securing the spout in a closed position.

Figure 11:
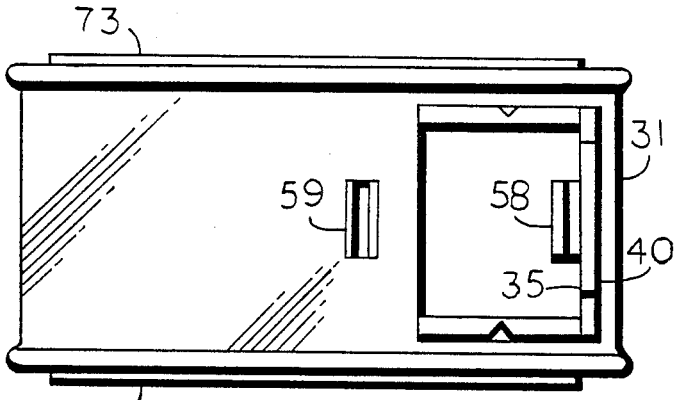
FIG. 11 is a top view of invention with snap lock closure.

FIG. 11, 12 and 13 utilize the ribbon wrap seal 44 and the clear or near clear plastic package having surfaces 33, recessed top, bottom and end surfaces 31 and raised protective edge 32. Flap 40 of intrinsic spout has molded on the tab 35 a elongated enlarged edge snap 58. When flap 40 is folded closed snap 58 is forced into elongated undercut groove 59 thus securing flap 40 in the closed position.

Figure 14:
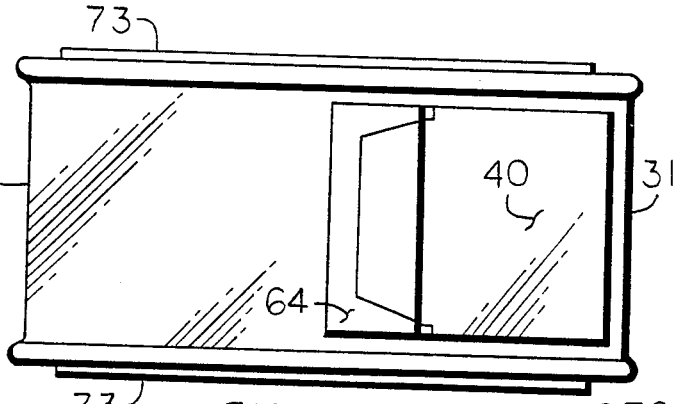
FIG. 14 is a top view of invention with tuck tab closure, closed.

FIG. 14, 15 and 16 utilize the ribbon wrap seal 44 and the clear or near clear plastic package having surfaces 33, recessed top, bottom and end surfaces 31 and raised protective edge 32. This design has a intrinsic molded spout with full length and height sides 62 joining flap 40 to end flap 64. Spout support sides 62 have multiplicate live hinge relief lines 63 which allows the sides 62 to be folded in and over the package opening. End flap 64 and flap 40 being connected by support sides 62 automatically fold in and over the package opening when closed. When spout is nearly closed, flap 40 is inserted inside flap 64 and forced flat to close package opening as seen in FIG. 14.

Figure 17:
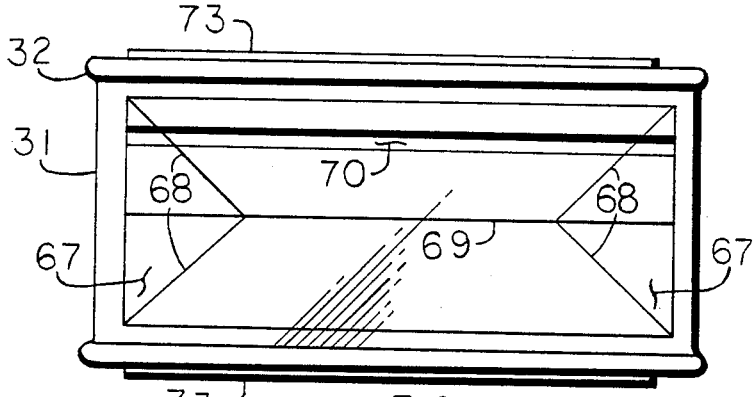
FIG. 17 is a top view of invention with a full length open top, heat sealed and folded flat.

FIG. 17, 18 and 19 utilize the ribbon wrap seal 44 and the clear or near clear plastic package having surfaces 33, recessed top , bottom and end surfaces 31 and raised protective edge 32, with a continuous open top formed by spout sides 66 and spout ends 67. Live hinge relief lines 68 on spout ends 67, FIG. 17 and 18, allows the folding together of sides 66, FIG. 19, to form a contact surface from live hinge relief line 69 to the edge of the opening 72. This contact surface between relief 69 and edge 72 is then heat sealed 70 for retained freshness of the products in the package. To open this type package a tear or cut can be made at the heat seal 70. Directional line 71 is intended to fold flat, after heat sealing 70, the sides 66 below the protective raised edge 32 and whereby the ribbon wrap seal 44 can circumvent and seal the package.

OPERATION

The plastic package of FIG. 1 will perform a wide variety of packaging functions including the storage and retailing of dried cereals, detergents, cake mixes, etc. and users will find it most useful when the package is of a clear plastic and they can identify with what is in the package and use the intrinsic molded pour spout to dispense the packages contents.

The ribbon wrap seal 44, FIG. 1 to 19, performs a number of functions, first as a device to keep the spout closed, next as an atmospheric barrier extending wider than the package opening, next as a tamper evident device in that once the wrapper has been bonded together by the manufacturer it can not be re-bonded once opened. Preferably the ribbon wrap seal 44 is narrower than the clear plastic package sides, top and bottom 31 whereby a partial view of the packages contents can be made, Additionally the ribbon wrap 44 would have advertisement, product description, price bar code, coupon promotions, etc.. The consumer, when opening the package, grips a loose edge of the ribbon wrap 44 near the bonding overlap point 45 and peels the wrap 44 off the package.

The clear or near clear plastic package has three major physical distinction other than the spout, described below. The package preferably will be manufactures by blow molding in a process similar to one gallon plastic milk bottles. The thermoplastic used in blow molding can be any of a number of grades or types such as clear PVC, Polyethylene, Polyester, or other new engineered plastics or copolymers suitable and acceptable by the Food & Drug Administration when in contact with foods or a plastic suitable for the product to be put into the package. The blow molding process whether it is parison and single mold, continuous rotational mold, ram extruder, etc., is deemed to be the most practical considering technology available today, although injection molding may be an alternative. The physical distinctions of the package invention are a one piece molded part. The ends, top and bottom surface 31 are to be recessed below the raised ridge edge 32 and the ribbon wrap 44 covers this surface 31. The surface 31, of a thickness 43, is molded continuously upward to the crown of edge 32 and continuously down sides 33. This molded edge 32 forms a double wall thickness 43 at the ridge greatly increasing the rigidity of the package. The primary function of edge 32 is a protective edge but it also serves as a locator for the ribbon wrap 44. The blow molding of a single unit parison eliminates overlapping bonded seams. The sides 33 of the plastic package commonly referred to as the front and back are of similar thickness 43 and can be smooth or have an embossed or engraved surface 33. The preferred embodiment of this invention regarding the sides 33 is to adhere a poster or plaquard 73, FIG. 16, to surface 33, the poster 73 being pre-printed with identification and other advertisement. The poster 73 may be opaque but should be smaller than the area of side 33 whereby the customer could view the product inside the package. This invention of a clear plastic package allows a manufacturer to utilize both sides, inside and face, of the poster 73 for printed information. Therefore, as the customer empties the clear plastic package, they see through the package that there is additional information on the back side of poster 73 which if they wish they can remove the poster 73 and use the information thereon.

A major embodiment of this invention is the molded insitu intrinsic spout of various design possibilities shown in FIGS. 1 through 16. FIGS. 1, 14, 15 and 16 are the preferred embodiment of a spout design due to simplified manufacturing processes. The blow molded clear plastic package is air pressure formed inside the parison through the spout opening then trimmed at edge 72. Also formed during the blow molding pressure cure cycle are the live hinge relief lines 63 on surface 62 and live hinge relief lines 39 at the connecting points of sides 40, 62 and 64 to surface 31. The thickness 43 is the same throughout the spout as it is in the package body. When a manufacturer or processer is to fill this invented package a product filler spout is indexed into the package spout opening. The indexed filler spout may be vented to allow the escaping air out of the package displaced by the product being put into the package. When the clear plastic package is full of product mechanical or physical effort must be made to collaspe sides 62 over the package opening and insertion of flap 40 into spout end 64, see FIG. 14. The package now filled with product and closure spout closed is ready for the ribbon wrap 44 seal over the closure spout and around surface 31 and application of posters 73. The user removes ribbon wrap seal 44, extricates flap 40 out of spout end 64 and fourcing open sides 62 providing a opening with the intrinsic spout suitable for dispensing the package contents, then reversing the process to close and store the package for future use.

Other spout closure designs are evident in FIGS. 2 to 16 and apply to the clear package design described above. FIGS. 17, 18 and 19 utilize the same construction and design of the clear plastic package described above with the exception that the top surface 31 has a significantly larger opening nearly covering the entire top surface 31. This large opening accommodates packaging of bulkier products such as clothing, toys or long term storage items. The large opening package spout side walls 66 and ends 67 are trimmed to a equal height at edge 72. Live hinge relief lines at 68, 69 and 74 are molded insitu and when folded inward close the opening creating a contact surface between hinge 69 and edge 72 on surface 66 which is heat sealed 70 the full length of surface 66. A manufacturer or processer has a large opening to index a product spout through and the user can tear or cut along the heat seal line 70 to remove the product.

While the above descriptions contain many specificities, the reader should not construe these as limitations on the scope of the invention, but merely as exemplifications of preferred embodiments thereof. Those skilled in the art will envision many other possible variations with its scope, for example skilled artisans will readily be able to change the implied dimensions, design and shapes of the various embodiments or construct in pieces, later bonding the pieces together. They could eliminate the protective edge 32. They could produce an opaque plastic package which could not be seen into or produce the package out of a cardboard material but still use the ribbon wrap seal 44. The size of this embodiment could be very small, for a diamond ring, or extremely large, like a transport container, depending on the product to be packaged. They could use the package as an arts and crafts media. They could develop numerous designs of closures and closure placement could vary from top 31, to sides 33, to ends 31 or even bottom 31. They can choose manufacturing processes such as rotational molding or even vacuum. Additionally they can rename the ribbon wrap 44 or intrinsic spout or name the package a carton, box or capsule.

Thus the reader will see that the clear or near clear plastic package with intrinsic spout and ribbon wrap seal provides a highly reliable, light weight, visible, economical package which can be used in displaying and storage of numerous products. Accordingly the reader is requested to determine the scope of the invention by the appended claims and their legal equivalents, and not by the examples given.

I claim:

1. A package, comprising upright front and back panels, top, bottom and opposite end walls, each integrally connected to both said front and back panels and extended between said front and back panels, whereby said package is free of seams between said panels and walls, a spout through one of said walls, a closure flap integrally formed with one of said walls and movable between a closed position operatively covering and closing said spout and an open position away from said spout whereby contents may be inserted into and removed from said package through said spout, flap securement means for releasably securing said flap in the closed position thereof, and a removable elongated ribbon wrap extended around said package over said spout and operative to obstruct movement of said closure flap from its closed position and thereby prevent access to the contents of said package prior to removal of said ribbon wrap.

2. The package of claim 1 wherein said closure flap includes an end panel wall hinged to said one wall and two parallel side support panel walls connected to an extended between said end panel wall and said one wall, each side support panel having fold lines defined by live hinge relief valleys whereby said side support panel walls may be collapsed upon movement of the closure flap to the closed position thereof.

3. The package of claim 2 wherein said end panel wall includes a flap extension and said flap securement means comprises a slot in said one wall adjacent said spout for receiving said flap extension upon closing said closure flap.

4. The package of claim 2 wherein said end panel wall is integrally connected to said one wall by a live hinge relief valley.

5. The package of claim 3 wherein said flap extension includes a thumb grip.

6. The package of claim 2 wherein said end panel wall includes a flap extension said flap securement means comprises a contact adhesive on said one wall adjacent said spout and opposite said flap end panel wall for releasably engaging said flap extension upon closing said closure flap.

7. The package of claim 2 wherein said flap end panel wall includes a flap extension and said flap securement means comprises a cantilevered elongated lock tab on the underside of said flap extension, and a cantilevered elongated groove positioned on said one wall for releasably receiving said lock tab.

8. The package of claim 2 wherein said flap closure means comprises a tension lock tab on the underside of said flap end panel wall and a coacting slot on said one wall for releasably receiving said tension lock tab.

9. The package of claim 2 wherein said flap end panel wall includes a flap extension and said flap securement means comprises an elongated enlarged edge snap lock on said flap extension and an elongated undercut groove on said one wall at a position for releasably receiving said edge snap lock.

10. The package of claim 1 wherein the intrinsic connected parallel spout side support and end panel walls are of substantially equal height, said parallel end panel walls having live hinge relief valleys at fold lines, said parallel side support panel walls being substantially as long as said one wall with longitudinal live hinge relief valleys connecting both to said one wall said side support panel walls being dimensioned to bring the two sides together contacting at longitudinal live hinge lines, the contacting surfaces of side support panel walls being heat-sealed in a narrow area parallel to the longitudinal live hinge with the material above it being a tear tab whereby pulling on said tear tab severs the package material along the edge of the contacting surfaces, said heat-sealed contacting surfaces and end and side support panel walls being foldable substantially flat below the front and back surface peripheral edges.

11. The package of claim 1 formed by injection blow molding.

12. The package of claim 1 formed from flat stock material with connecting bonded seams.

13. The package of claim 1 further comprising a poster and means for securing said poster onto one of said front and back panels, said poster providing for double sided information printing comprising a plastic film opaque in color eliminating reverse side visible through the panels and walls of said package.

14. A package, comprising upright front and back panels, top, bottom and opposite end walls connected to and extended between said front and back panels, a spout through one of said walls, a closure flap integrally formed with one of said walls and movable between a closed position operatively covering and closing said spout and an open position away from said spout whereby contents may be inserted into and removed from said package through said spout, flap securement means for releasably securing said flap in the closed position thereof, and a removable elongated ribbon wrap extended around said package over said spout and operative to obstruct movement of said closure flap from its closed position and thereby prevent access to the contents of said package prior to removal of said ribbon wrap, said front and back surfaces having peripheral edges, said top, bottom and opposite end walls being recessed relative to said peripheral edges.

15. The package of claim 14 wherein said ribbon wrap substantially covers said walls between said peripheral edges.

16. A package, comprising upright front and back panels, top, bottom and opposite end walls connected to and extended between said front and back panels, a spout through one of said walls.

a closure flap integrally formed with one of said walls and movable between a closed position operatively covering and closing said spout and an open position away from said spout whereby contents may be inserted into and removed from said package through said spout, flap securement means for releasably securing said flap in the closed position thereof, and a removable elongated ribbon wrap extended around said package over said spout and operative to obstruct movement of said closure flap from its closed position and thereby prevent access to the contents of said package prior to removal of said ribbon wrap, said closure flap including and end panel wall hinged to said one wall and two parallel side support walls connected to and extended between said end panel wall and said one wall, each side support panel having fold lines defined by live hinge relief valleys whereby said side support panel walls may be collapsed upon movement of the closure flap to the closed position thereof, said closure flap further comprising a second end panel wall hingedly connected to said side support panel walls and to said one wall adjacent said spout opposite said end panel wall.

17. The package of claim 16 wherein said end panel wall includes a flap extension which removably tucks inside an envelope formed by said second end panel wall and side support panel walls upon closing said closure flap.

18. A package, comprising upright front and back panels, top, bottom and opposite end walls connected to and extended between said front and back panels, a spout through one of said walls, a closure flap integrally formed with one of said walls and movable between a closed position operatively covering and closing said spout and an open position away from said spout whereby contents may be inserted into and removed from said package through said spout, flap securement means for releasably securing said flap in the closed position thereof, and a removable elongated ribbon wrap extended around said package over said spout and operative to obstruct movement of said closure flap from its closed position and thereby prevent access to the contents of said package prior to removal of said ribbon wrap.

said ribbon wrap having a predetermined width wider than said spout, said ribbon wrap having a length to circumvent the package to, bottom and opposite end walls, said ribbon wrap having one free end adhered to a wall on one side of said spout, traversing over said spout and thereby securing the closure flap closed and sealed, and continuing around the package circumference back to said one free end, the opposite end overlapping the first free end and adhering to the previously positioned wrap, said opposite end having a non-adhered free pull tab whereby pulling on said pull tab severs the adhesive bond permitting the removal of the complete ribbon wrap from said package.

19. The package of claim 18 wherein said ribbon wrap is an elastomeric plastic ribbon.

* * * * *